US005103764A

United States Patent [19]

Fujiwara et al.

[11] Patent Number: 5,103,764

[45] Date of Patent: Apr. 14, 1992

[54] DEVELOPING DEVICE DRIVE MECHANISM FOR SELECTING AND POWERING DEVELOPING UNITS

[75] Inventors: Takao Fujiwara; Hideo Kitakubo, both of Osaka, Japan

[73] Assignee: Minolta Camera Kabushiki Kaisha, Osaka, Japan

[21] Appl. No.: 758,178

[22] Filed: Sep. 11, 1991

Related U.S. Application Data

[63] Continuation of Ser. No. 474,408, Feb. 2, 1990.

[30] Foreign Application Priority Data

Feb. 3, 1989 [JP] Japan ..... 1-26256

[51] Int. Cl.[5] ..... G03G 15/01

[52] U.S. Cl. ..... 118/645; 355/326

[58] Field of Search ..... 355/200, 245, 326, 327; 118/645; 74/665 F, 665 GE

[56] References Cited

U.S. PATENT DOCUMENTS 4,788,574 11/1988 Matsumoto et al. ..... 355/326
4,841,329 6/1989 Kasamura et al. ..... 355/245
4,870,456 9/1989 Watanabe et al. ..... 355/326 X
4,928,146 5/1990 Yamada ..... 355/326 X

FOREIGN PATENT DOCUMENTS 0287122 10/1988 European Pat. Off. .
60-4179 2/1985 Japan .
0112177 5/1987 Japan ..... 355/245
0220181 9/1988 Japan ..... 355/326
63-261282 10/1988 Japan .

*Primary Examiner*—Arthur T. Grimley
*Assistant Examiner*—J. E. Barlow, Jr.
*Attorney, Agent, or Firm*—Willian Brinks Olds Hofer Gilson & Lione

[57] ABSTRACT

A developing device for color copiers and the like. The developing device has a plurality of developing units, each of which has a developing roller for developing an electrostatic latent image formed on an image carrier; a developing unit switching device for moving the developing units linearly and for selecting one of the developing units to oppose the image carrier; a fixed driving source for generating a driving force to drive the developing rollers; wrapping connecting apparatus which has a wrapping member and movable rotating structure having at least one rotating member and movable together with the developing units, the wrapping connecting apparatus being for conveying the driving force to the movable rotating structure; and a plurality of clutches, each of which is provided for one developing unit and is switched to a first state wherein the clutch conveys the driving force from the movable rotating structure to the developing roller and to a second state wherein there is no conveyance.

16 Claims, 12 Drawing Sheets

113
60
126
127
1270
129
128
1290
(60)
E
131
125
130
123
124
e
A
B
122
121
116
120
D
134
115
1150
131

SECTION XIIIa-XIII
SECTION XIIIb-XIII

DEVELOPING DEVICE DRIVE MECHANISM FOR SELECTING AND POWERING DEVELOPING UNITS

This application is a continuation of application Ser. No. 07/474,408, filed Feb. 2, 1990.

BACKGROUND OF THE INVENTION (1) Field of the Invention

This invention relates to a developing device employed in a color copier or the like.

(2) Description of the Related Art

A conventional developing device of this type has been disclosed in Japanese Patent Publication Kokai No. 63-261282. According to this invention, a plurality of developing units are provided around a photoconductive drum, and each developing unit is driven by driving means provided at an end of the photoconductive drum. Such a construction has three main problems: 1) the construction of a driving system is inevitably complicated; 2) the complicated construction around the photoconductive drum and the strictly-restricted arrangement prevent compactness and efficient maintenance; and 3) since each developing unit has different positional relationship with the photoconductive drum, it is hard to uniformize shapes and constructions of the developing units.

The inventors of the present invention have disclosed another conventional developing device in Japanese Patent Application No. 63-83502. According to this invention, a developing device comprising a plurality of developing units arranged in shelves from top to bottom is moved up and down by a developing device driving motor and each developing unit is driven by a corresponding developing unit driving motor for development. However, this invention has the following problems since the developing units, each of which has the developing unit driving motor, increases the weight and size of the whole developing device: 1) the large force of inertia for moving and stopping the developing device deteriorates controllability of moving up and down the device; 2) the large load applied on the developing device driving motor requires the motor to be large-sized, thereby to enlarge the size of the whole device; 3) the large-sized device increases manufacturing cost; 4) the large-sized device is required to move a long distance and takes a long time for selecting one of the developing units, which prolongs operation time; and 5) since the size of each developing unit is determined by the specification torque of the corresponding developing unit driving motor, the design of each developing unit and the whole device is restricted.

SUMMARY OF THE INVENTION

Accordingly, this invention, made to solve the above problems, has an object of offering a developing device wherein developing units are moved up and down and selectively driven by a simple driving system.

The above object is also fulfilled by a developing device [A] comprising a plurality of developing units, each of which has a developing roller for developing an electrostatic latent image formed on an image carrier; supporting means for supporting the plurality of developing units vertically-movably against the image carrier; a fixed driving source for generating a driving force to drive the developing rollers; wrapping connecting means comprising a wrapping member and movable rotating means including at least one rotating member and vertically-movable together with the developing units, the wrapping connecting means being for conveying the driving force to the movable rotating means; and a plurality of clutch means, each of which is provided for one developing unit and is switched to a first state wherein the clutch conveys the driving force from the movable rotating means to the developing roller and to a second state wherein there is no conveyance.

The above object is also fulfilled by a developing device comprising a plurality of developing units, each of which has a developing roller for developing an electrostatic latent image formed on an image carrier; developing unit switching means for moving the developing units linearly and selecting one of the developing units to oppose the image carrier; a fixed driving source for generating a driving force to drive the developing rollers; wrapping connecting means comprising a wrapping member and movable rotating means including at least one rotating member and movable together with the developing units, the wrapping connecting means being for conveying the driving force to the movable rotating means; and a plurality of clutch means, each of which is provided for one developing unit and is switched to a first state wherein the clutch conveys the driving force from the movable rotating means to the developing roller and to a second state wherein there is no conveyance.

The above object is also fulfilled by a developing device comprising a plurality of developing units, each of which has a developing roller for developing an electrostatic latent image formed on an image carrier; developing unit switching means for moving the developing units linearly and selecting one of the developing units to oppose the image carrier; a fixed driving source for generating a driving force to drive the developing rollers; wrapping connecting means comprising a wrapping member and movable rotating means including at least one rotating member and movable together with the developing units, the wrapping connecting means being for conveying the driving force to the movable rotating means; a plurality of clutch means, each of which is provided for one developing unit and is switched to a first state wherein the clutch conveys the driving force from the movable rotating means to the developing roller and to a second state wherein there is no conveyance; and control means for switching the clutch means to the first state and to the second state.

The above object is also fulfilled by a developing device [A], wherein the wrapping member is extended by an upper rotating member, a lower rotating member and the movable rotating means, the upper rotating member and the lower rotating member being respectively fixed above and below the developing units. (This device will be referred as to [B] hereinafter).

In the above construction, the developing units are selectively driven by a fixed driving source through the wrapping connecting means and the clutch means in order to conduct development. Consequently, the driving system which is movable integrally with the developing units is light, simple and compact. This improves controllability of the device and development efficiency, lowers manufacturing cost and widens the possibility of design.

This invention has another object of offering a developing device wherein simple wrapping connecting means provides driving force conveyance without fail.

The above object is fulfilled by the developing device [B], wherein a portion of the wrapping member extended between the upper rotating member and the movable rotating means and another portion of the wrapping member extended between the movable rotating means and the lower rotating member are in parallel with a moving direction of the developing units.

According to the above construction, the sum of the lengths of a portion of the wrapping member extended between the upper rotating member and the lower rotating member and another portion of the wrapping member extended between the moving rotating means and the lower rotating member is kept uniform. Therefore, the tension of the wrapping member is always the same wherever the developing units are. This also provides driving force conveyance without fail with no extra means for adjusting the tension of the wrapping member being required.

This invention has still another object of offering a developing device wherein the angles of contact of a wrapping member around movable rotating means are enlarged so as to make driving force conveyance more secure.

The above object is fulfilled by the developing device [A], wherein the movable rotating means comprises a plurality of movable rotating members and the wrapping member is in contact with a first movable rotating member and a second movable rotating member on opposed sides of the wrapping member.

According to this construction, if the first movable rotating member is disposed so that the the wrapping member be wound around with a large angle of contact, the wrapping member is naturally wound around the second movable rotating member with a large angle of contact. This makes driving force conveyance more secure.

This invention has still another object of offering a developing device wherein one driving source is used for moving the developing unit and also for driving the developing rollers of the developing units in order to simplify the construction.

The above object is fulfilled by the developing device [B], wherein a portion of the wrapping member between one of the upper and lower rotating members and the movable rotating means, is in parallel with the moving direction of the developing units and the above portion is passed along fixed means for fixing the relative positions of the developing units with the wrapping member.

The above object is fulfilled by the developing device [B], wherein two portions of the wrapping member between the upper rotating member, the lower rotating member and the moving rotating means are in parallel with a moving direction of the developing units and the above two portions are run oppositely and are passed along fixed means for fixing the relative positions of the developing units with the wrapping member.

When each developing unit has a fixed positional relationship with the wrapping member by the above construction, the driving source for driving the developing rollers is used for moving the developing units.

This invention has still another object of offering a developing device wherein the driving force of a driving source is conveyed to the developing units without fail whether the developing units are at a developing position close to an image carrier or at a retracting position far from the image carrier.

The above object is fulfilled by the developing device [A], further comprising moving means for moving the developing units between a developing position close to the image carrier and a retracting position far from the image carrier, a pivoting lever and a gear rotatably attached to the pivoting lever, wherein the pivoting lever is pivoted to cause the gear to convey the driving force from the movable rotating member to the developing units.

According to the above construction, since the pivoting lever is pivoted in accordance with the horizontal movement of the developing units, the driving force of a driving source is easily conveyed to the developing units whether the developing unit is at the developing position or at the retracting position.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

Figure 1:
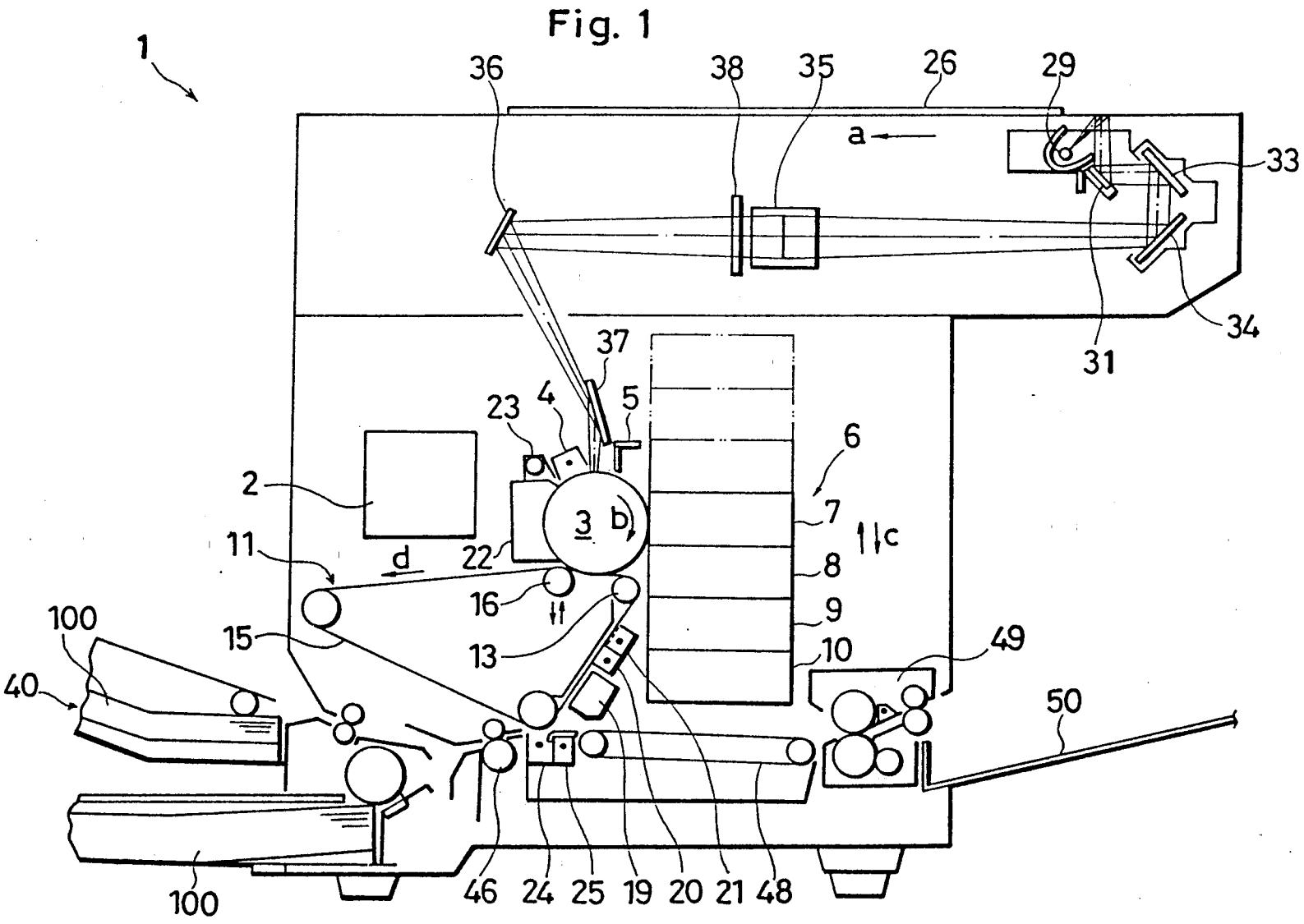
FIG. 1 is a vertical cross sectional view, seen from the front, of a color copier 1 equipped with a developing device 6 according to the present invention.

An embodiment of this invention will be described referring to figures. The color copier 1 equipped with the developing device 6 according to this invention is constructed as shown in FIG. 1 and operated as described hereinafter.

When a print switch (not shown) is turned on with a document (not shown) placed on a glass document table 26, an optical system comprising an exposure lamp 29 and mirrors 31, 33 and 34 scans the document in a direction of an arrow a, whereby a light emitted from the exposure lamp 29 and reflected on the document is irradiated on a photoconductive drum 3 through the mirrors 31, 33 and 34, a lens 35, a color separation filter 38 and another mirrors 36 and 37. The photoconductive drum 3 is exposed in this way.

When the print switch is turned on in the above, the photoconductive drum 3 is driven by a main motor 2 to rotate in a direction of an arrow b. Prior to being exposed in the above, a peripheral surface of the photoconductive drum 3 is already charged uniformly by a main charger 4. The electric charge on the surface is partially removed in accordance with the intensity of the irradiated light, whereby an electrostatic latent image is formed on the drum 3. The electric charge on a portion of the drum 3 which is not involved in image forming is removed by an editing eraser 5 disposed downstream from the main charger 4 (in the rotating direction of the drum 3).

The above electrostatic latent image is supplied with a toner from the developing device 6 disposed to the right of the drum 3, whereby the electrostatic latent image is developed into a toner image. The developing device 6 includes developing units 7 through 10 arranged from top to bottom which accommodate yellow, magenta, and black toners, respectively. The developing units 7 through 10 move up and down as shown with arrows c, whereby one of the colors is selected to be opposed to and sent to the drum 3. The developing device 6 will be described in detail later.

Provided downstream from the developing device 6 is a transfer device 11 including a transfer belt 15. The belt 15 is driven by the main motor 2 to travel around in a direction of an arrow d as fast as the circumferential speed of the drum 3 while being charged uniformly by a belt charger 21. The belt 15, after charged, is pushed upward by a pressing roller 16 to be lightly contacted with the peripheral surface of the drum 3 between the pressing roller 16 and another roller 13, whereby the toner image on the drum 3 is transferred onto the belt 15. (This will be referred to as the primary transfer.)

On the other hand, a paper 100 is supplied from a supplying section 40 and sent to between the belt 15 and a transfer charger 24 after an appropriate period of time in relation with the rotation of the drum 3. The above appropriate period of time is controlled by a timing roller 46. Then, the toner image on the belt 15 is transferred onto the paper 100. (This will be referred to as the secondary transfer.)

For color copying, a sequence of operation from drum exposure to the primary transfer is repeated, once for each color, thereafter the toner images in the multiple colors formed on the transfer belt 15 are transferred onto the paper 100 at the same time.

Then, the paper 100 is separated from the belt 15 by a separation charger 25, sent to a fixing device 49 by a transport belt 48 for having the image fixed thereon and then delivered to the delivery tray 50.

As for each portion of the drum 3 where the primary transfer is finished, the residual toner is cleaned off by a cleaner 22 and the residual charge is removed by a main eraser 23, whereby the drum 3 is prepared for the next round of image forming. As for each portion of the belt 15 where the secondary transfer is finished, the residual toner is cleaned off by another cleaner 19 and the residual charge is removed by a removing charger 20, whereby the belt 15 is prepared for the next round of transfer.

Figure 2:
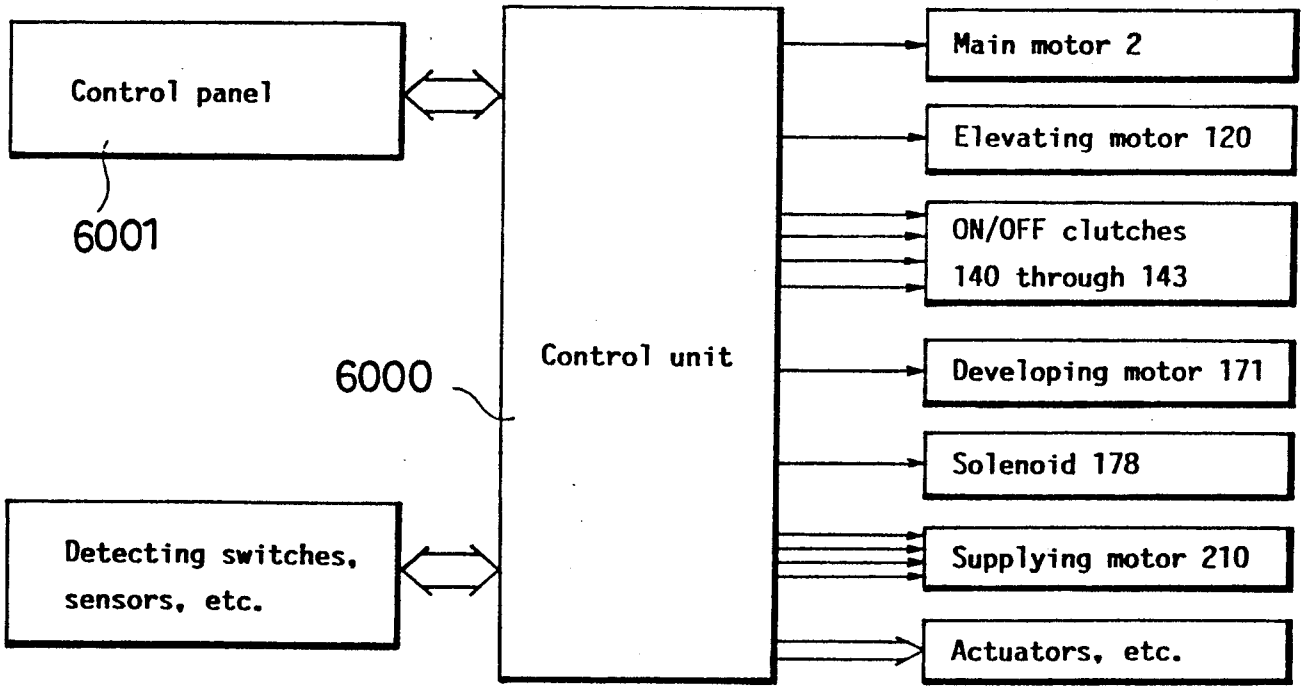
FIG. 2 is a block diagram of a control system of the copier 1.

The above operation of the copier 1 is controlled by a control unit 6000 shown in FIG. 2. The control unit 6000 is connected with a control panel 6001 equipped with the print and other switches and various displays, various detecting switches and sensors, the main motor 2, an elevating motor 120, ON/OFF clutches 140 through 143, a developing motor 171, a solenoid 178, a supplying motor 210, actuators, and the like.

The developing device 6 will be explained in detail hereinafter, referring to FIGS. 3 through 15.

Figure 3:
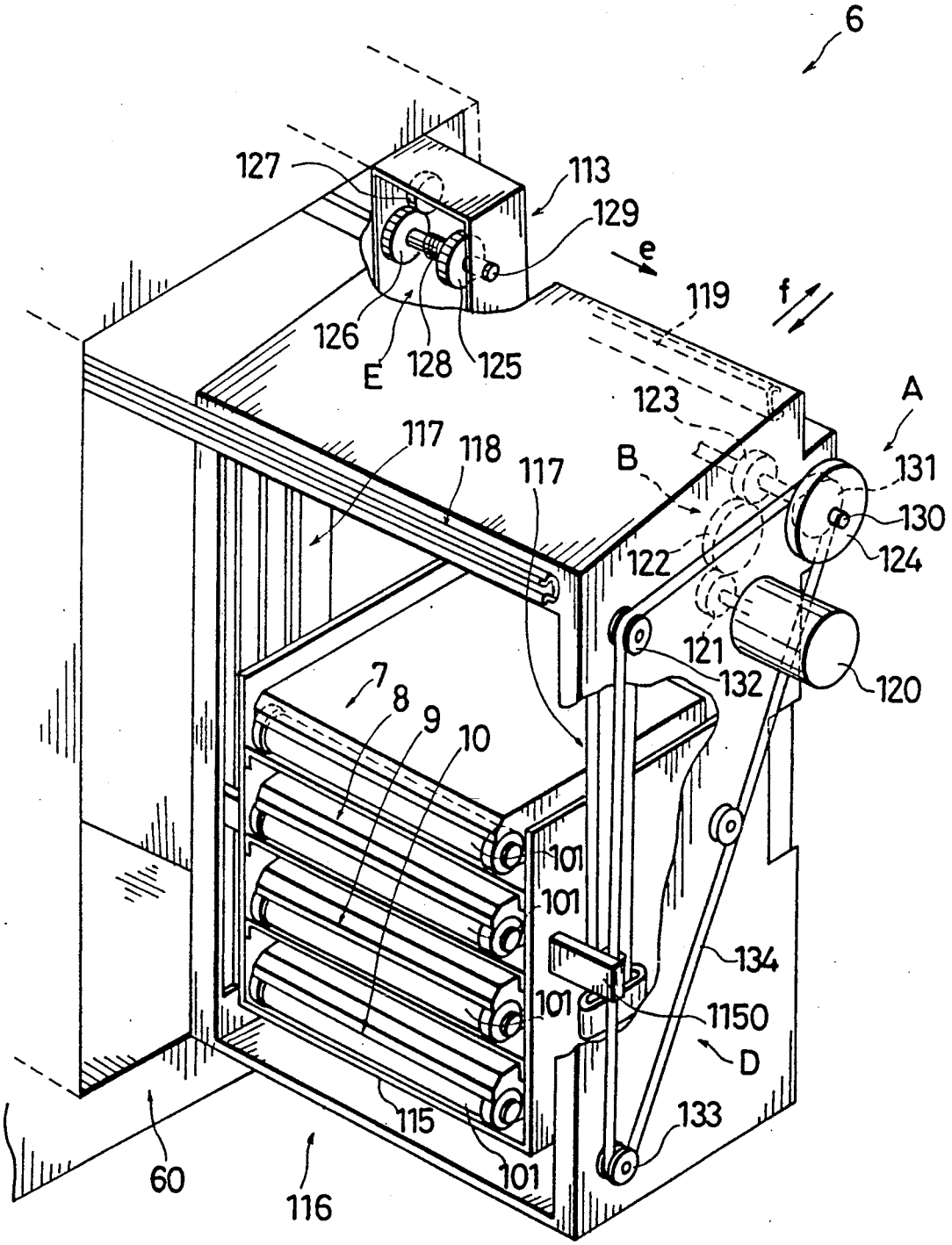
FIG. 3 is a perspective view of a developing device 6 seen from the upper left of FIG. 1.
Figure 4:
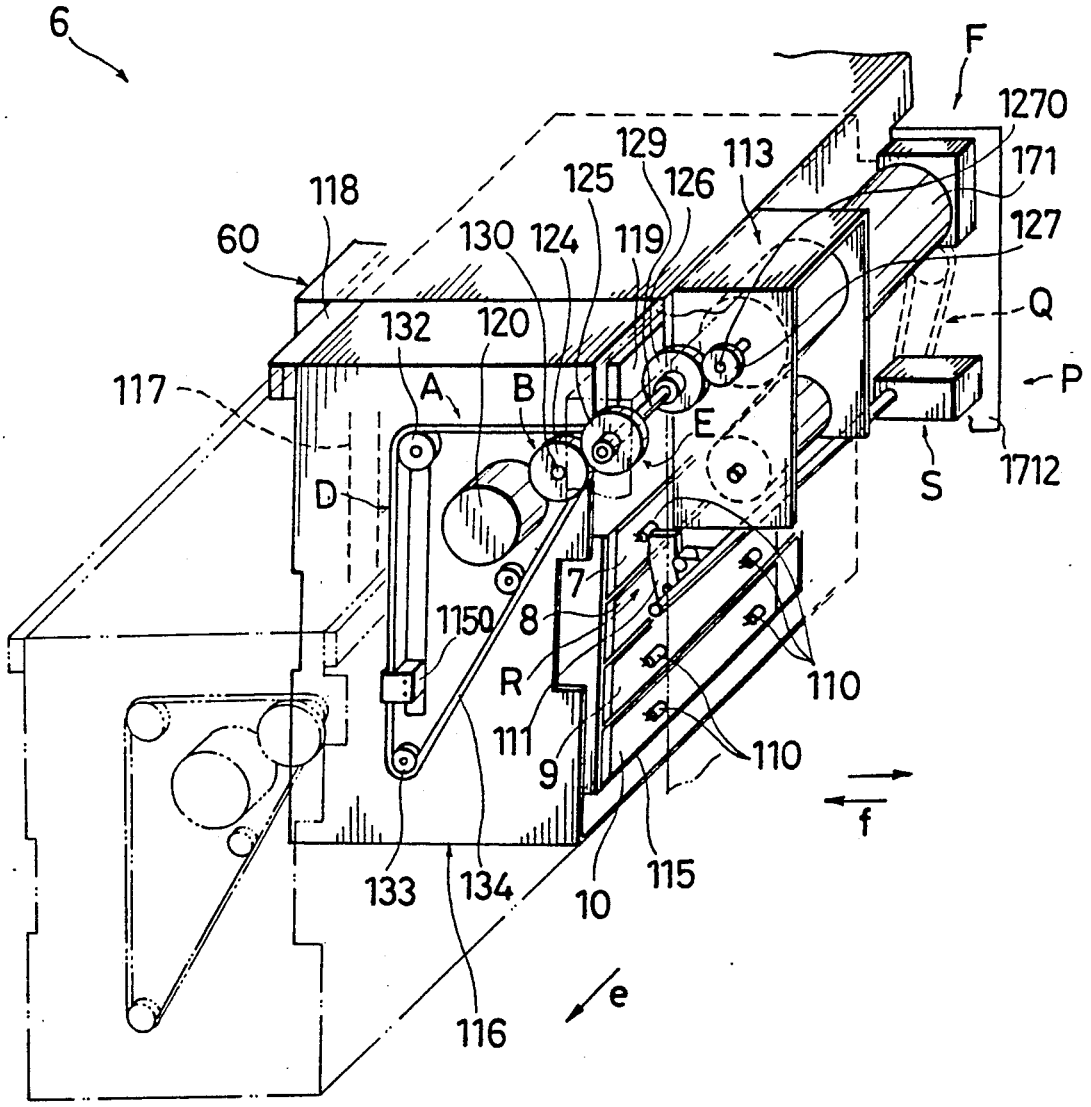
FIG. 4 is another perspective view of the same seen from the upper right of FIG. 1.

As shown in FIGS. 3 and 4, the developing device 6 comprises a casing 60, a developing body 116, and guide rails 118 and 119 for guiding the developing body 116 to be drawn out from the casing 60 in a direction of an arrow e. The developing body 116 accommodates a shelf unit 115 and has another guide rail 117 attached thereto for guiding the shelf unit 115 to move up and down. The shelf unit 115 has therein the developing units 7 through 10 arranged from top to bottom which accommodate the yellow, magenta, cyan and black toners, respectively, the developing units 7 through 10 being movable as shown with arrows f. The shelf unit 115 and the developing units 7 through 10 are movable up and down integrally, and further each developing unit is independently movable in the f directions when the developing body 116 is out of the casing 60.

An elevating mechanism A comprising the elevating motor 120, a gearing mechanism B and a chain sprocket mechanism D is attached to the developing body 116, the mechanism A being for moving up and down the shelf unit 115. Attached to the casing 60 are a weight compensating spring unit 113 for compensating weights of the shelf unit 115 and the like with a constant force, and another gearing mechanism E.

Figure 5:
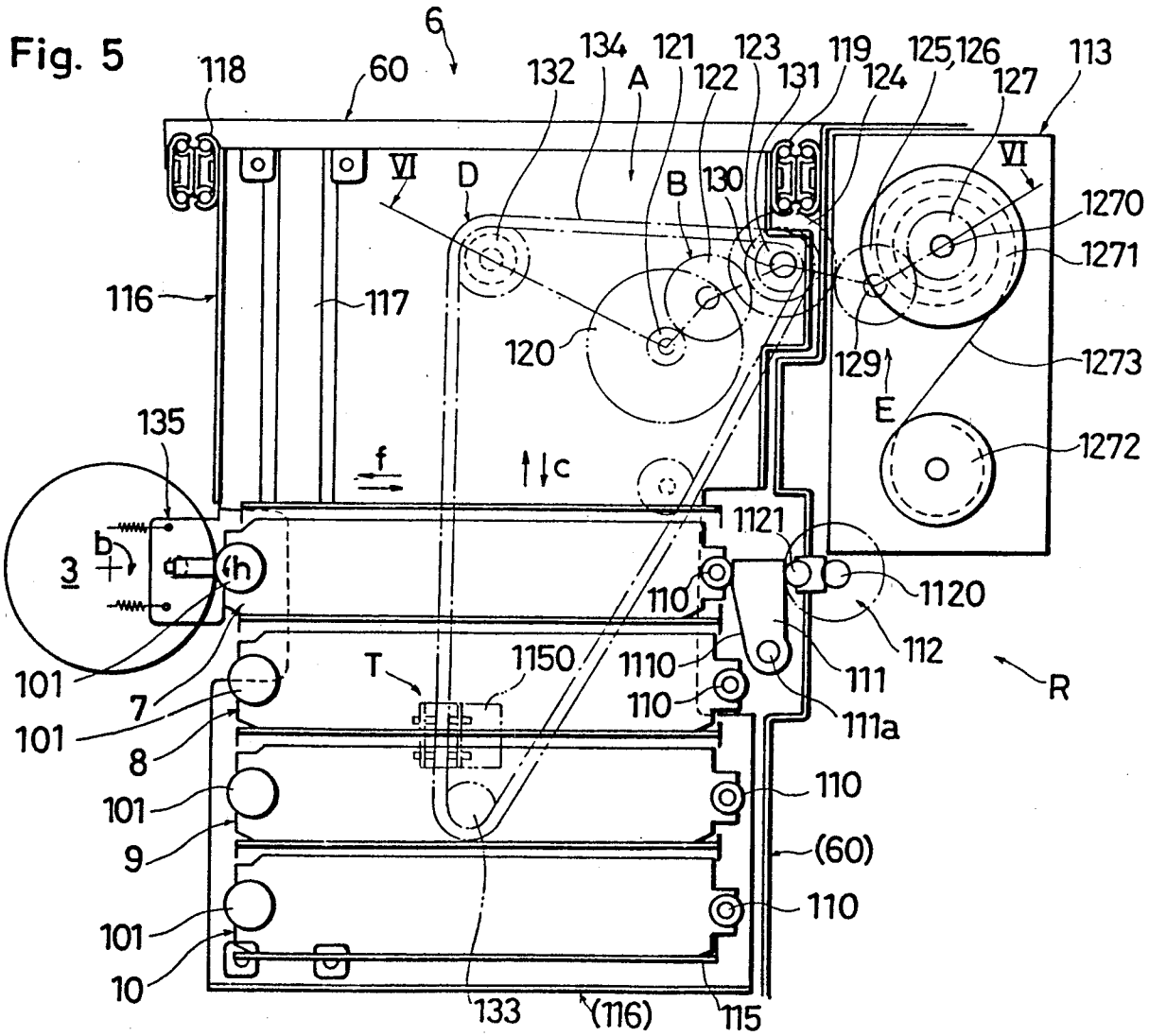
FIG. 5 is a cross sectional view of the same seen from the front of FIG. 1.
Figures 6, 7:
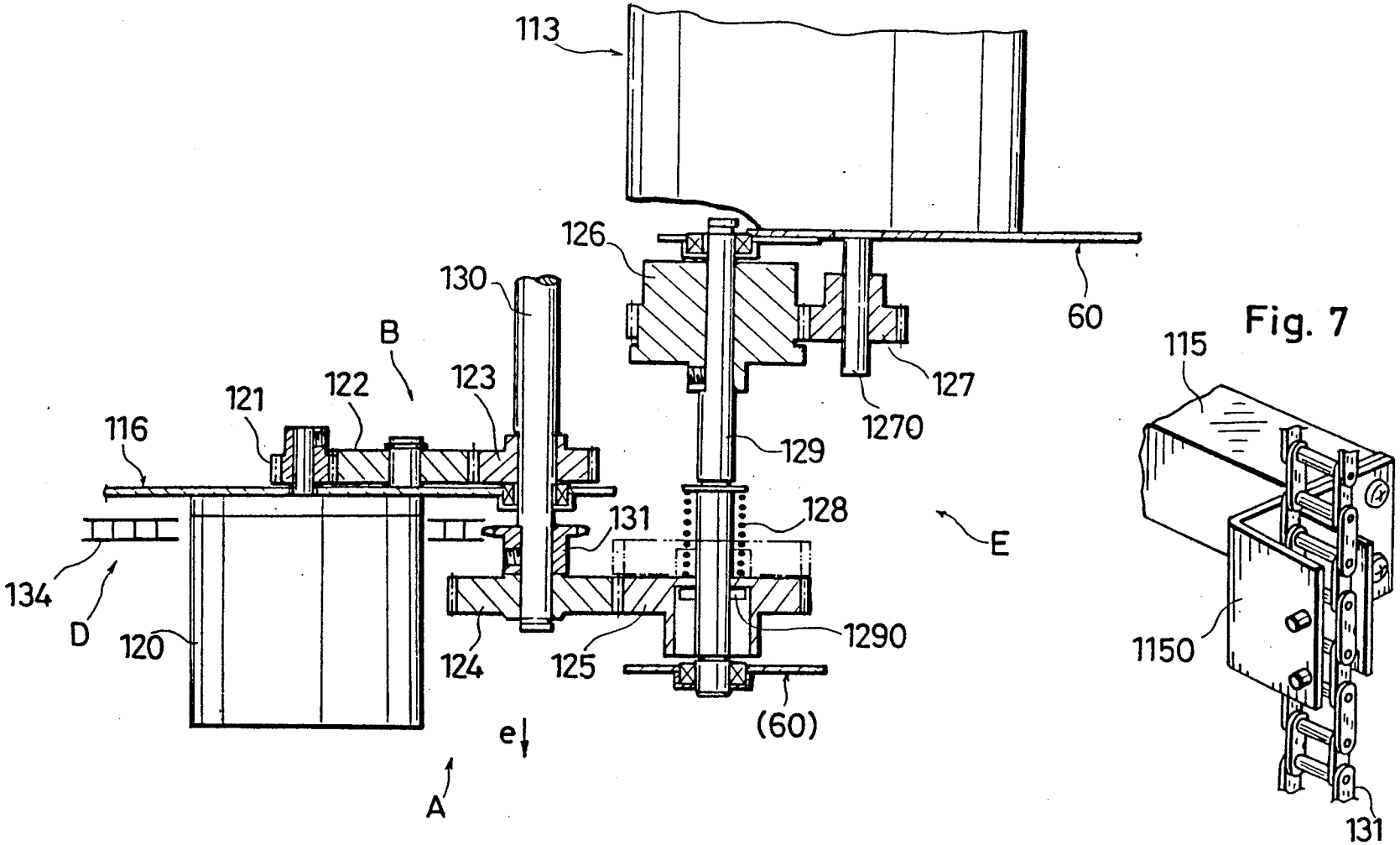
FIG. 6 is a cross sectional view of the same taken along the line VI—VI of FIG. 5.
FIG. 7 is an enlarged perspective view of a T part of FIG. 5.
Figure 8:
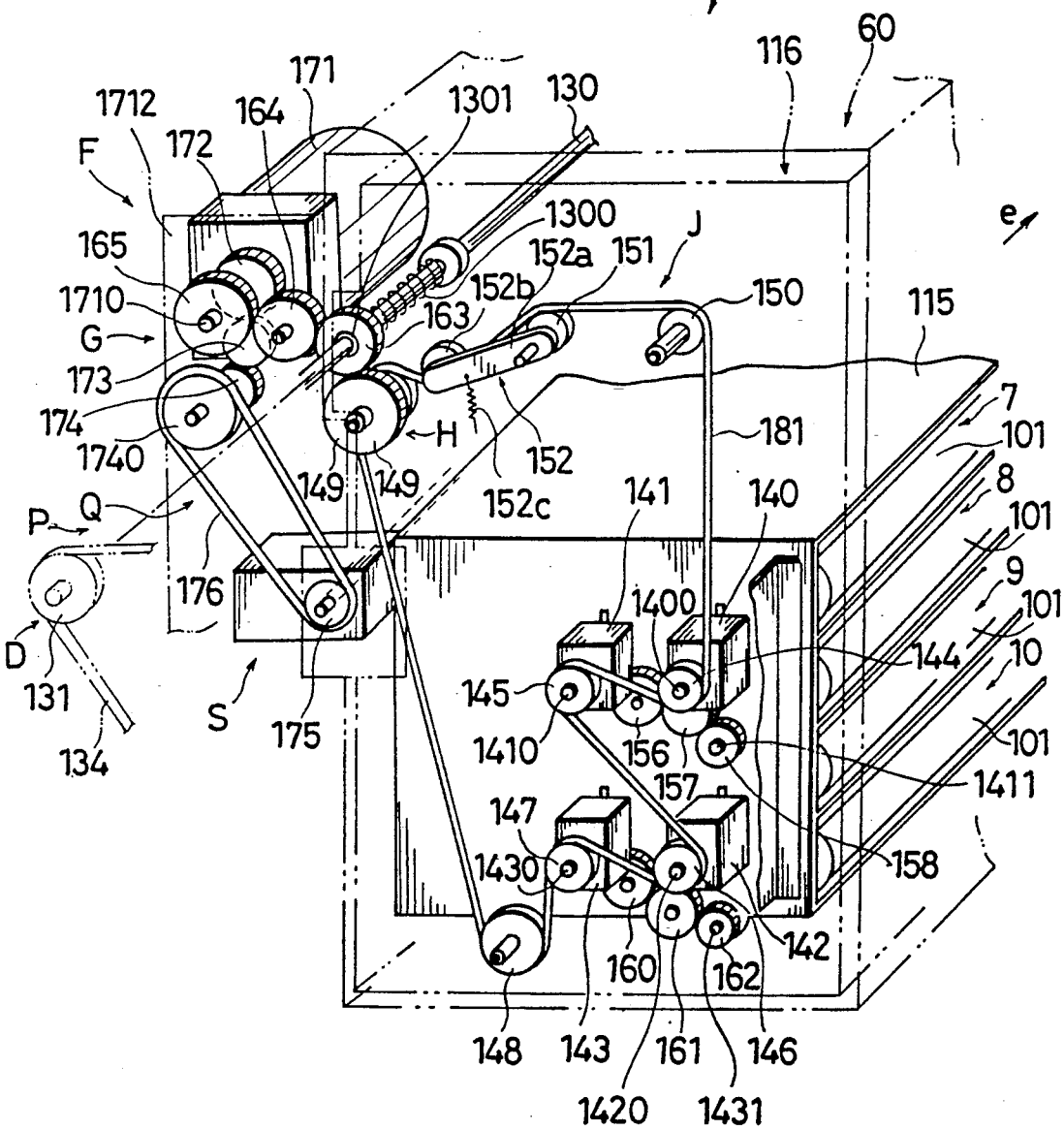
FIG. 8 is a perspective view of the developing device 6 seen from the back of FIG. 1.

As shown in FIGS. 5 and 6, the gearing mechanism B comprises a driving gear 121, an intermediate gear 122, an output gear 123 and a driving shaft 130. In this construction, the driving force of the elevating motor 120 is conveyed to a driving shaft 130 through the gears 121, 122 and 123.

The chain sprocket mechanism D comprises a driving sprocket 131 connected to the driving shaft 130, an upper subordinate sprocket 132 provided to the left of the driving sprocket 131, a lower subodinate sprocket 133 provided below the upper sprocket 132, and an endless chain 134 extended by the sprockets 131 through 133 in a loop. The sprockets 132 and 133 are arranged to run the chain 134 therebetween in parallel with the moving direction of the shelf unit 115. As shown in FIG. 7, the chain 134 is connected to the shelf unit 115 through a connecting member 1150, whereby to move the shelf unit 115 up and down.

Another set of chain sprocket mechanism D is attached to the back of the developing body 116 (FIGS. 8 and 10), to which the driving force of the elevating motor 120 is to be conveyed through the driving shaft 130.

As shown in FIG. 6, the gearing mechanism E has a gear 124 and an intermediate gear 125, another gear 126, a supporting shaft 129 for connecting the gears 125 and 126, and still another gear 127 connected to another supporting shaft 1270 and engaged with the gear 126. The supporting shaft 1270 belongs to the weight compensating spring unit 113.

When the developing body 116 is in the casing 60, the gear 124 attached to the developing body 116 and the intermediate gear 125 attached to the casing 60 are engaged with each other. When the body 116 is out of the casing 60, the two gears are released from each other.

It is necessary to accommodate the body 116 into the casing 60 smoothly even if the gears 124 and 125 are not well engaged. For realizing the smooth accommodation, the mechanism E further comprises a coil spring 128 and a ring 1290 fixed to the supporting shaft 129. The gear 125 is slidably provided around the supporting shaft 129. The gear 125 is energized in the e direction by the coil spring 128 and is positioned by the ring 1290. In this construction, if the gears 124 and 125 are not well engaged, the gear 125 is pressed by the gear 124 against the energizing force of the spring 128 in the opposite direction to the arrow e. After the body 116 is accommodated, the gear 125 is moved back for secure engagement when the gear 124 or 125 is rotated.

The force of the weight compensating spring unit 113 is conveyed to the driving shaft 130 through the mechanism E, whereby to rotate the shaft 130 in a direction to elevate the shelf unit 115. The total weight of the shelf unit 115, the developing units 7 through 10 and the like is balanced with the rotating force of the shaft 130 for making the load on the elevating motor 120 as small as possible.

As shown in FIG. 5, the weight compensating spring unit 113 comprises a drum 1271 supported by the supporting shaft 1270, another drum 1272 disposed below the drum 1271, and a spring member 1273 wound around these drums. In this construction, substantially the same rotating force is continuously generated by the unwinding force of the spring member 1273, irrespective of where the shelf unit 115 is.

As shown in FIGS. 8 through 11, the developing device 6 has a developing unit driving mechanism F and a driving section Q of a developing unit pressing mechanism P on the back thereof.

The developing unit driving mechanism F is for driving a developing sleeve 101 and stirring rollers 5001 and 5002 provided in each developing unit. The mechanism F comprises the developing motor 171 attached to the casing 60, another gearing mechanism G also attached to the casing 60, still another gearing mechanism H attached to the developing body 116, the chain sprocket mechanism J and the ON/OFF clutches 140 through 143 also attached to the developing body 116. The developing motor 171 is attached to a frame 1712 of the casing 60.

The gearing mechanism G (FIG. 10) comprises a driving gear 165 and an intermediate gear 164. The driving gear 165 is connected to a tip of an output shaft 1710 of the developing motor 171 and the gear 164 is rotatably attached to a frame 1640 of the casing 60 and thus engaged with the gear 165.

The developing mechanism H (FIG. 10) comprises a connecting gear 163 and a gear portion **149*a* of a gear sprocket 149 engaged with the gear 163. The gear 163 is rotatably supported by the driving shaft 130 and is also slidable in the axis direction of the shaft 130. Further, a coil spring 1300 and a ring 1301 are provided around the driving shaft 130, the ring 1301 being fixed. The gear 163 is energized toward the back of the body 116 by the coil spring 1300 and is positioned by the ring 1301. In this construction, the gear 163 attached to the developing body 116 and the gear 164 attached to the casing 60 are engaged with each other when the developing body 11 6 is accommodated in the casing 60 and released when the body 116 is out of the casing 60. If the gears 163 and 164 are not well engaged, the movement of the gear 163 in the opposite direction of the arrow e is restricted by the gear 164 against the energizing force of the coil spring 1300. After the body 116 is accommodated, the gear 163 is moved back for secure engagement when the gear 163 or 164 is rotated. The gear sprocket 149 has a larger facewidth than the gear 163 so that the gear 163 and the gear sprocket 149 can still be engaged even if the gear 163 is restricted by the gear 164**.

Figure 9:
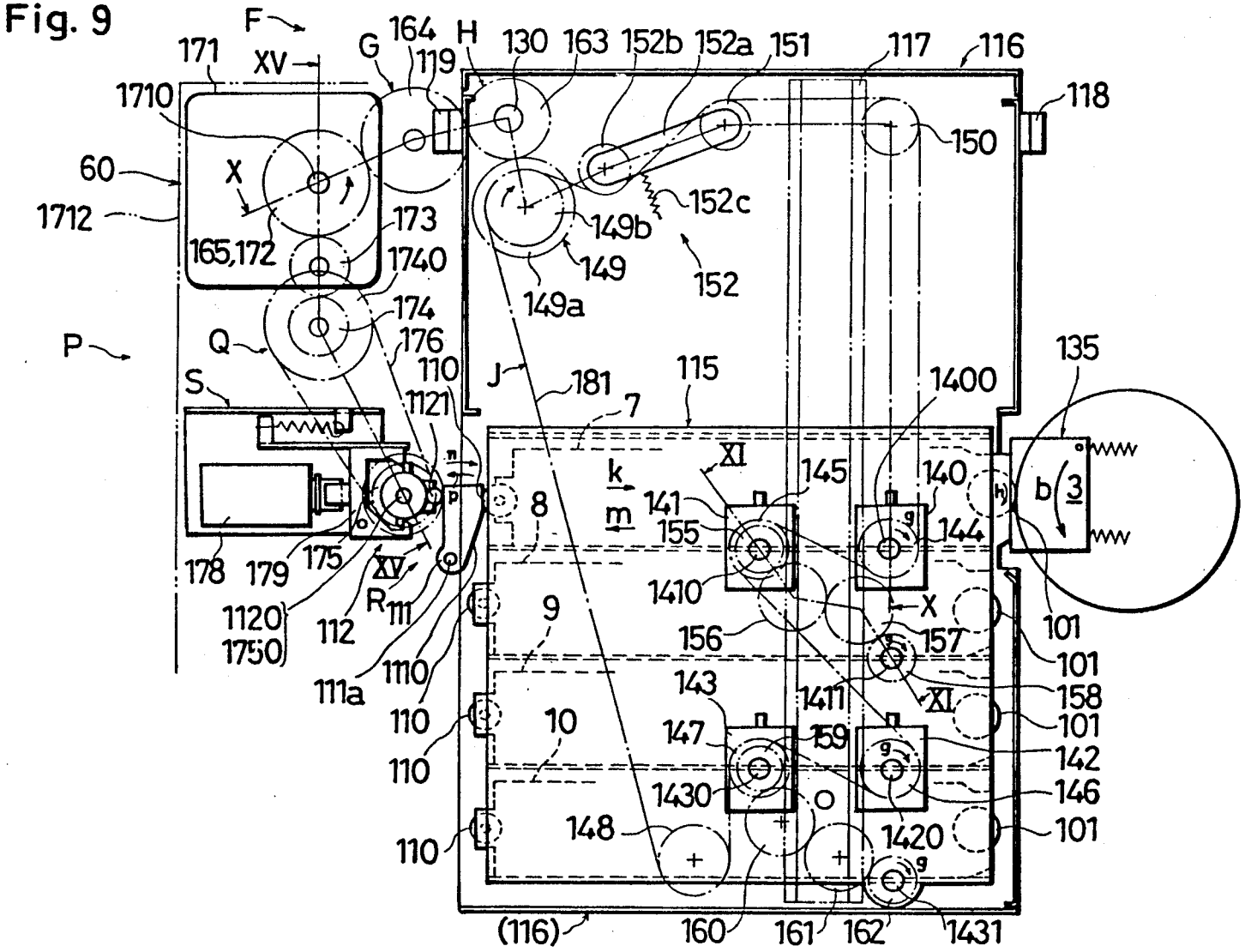
FIG. 9 is a cross sectional view of a developing body 116 seen from the back of FIG. 1.
Figure 10:
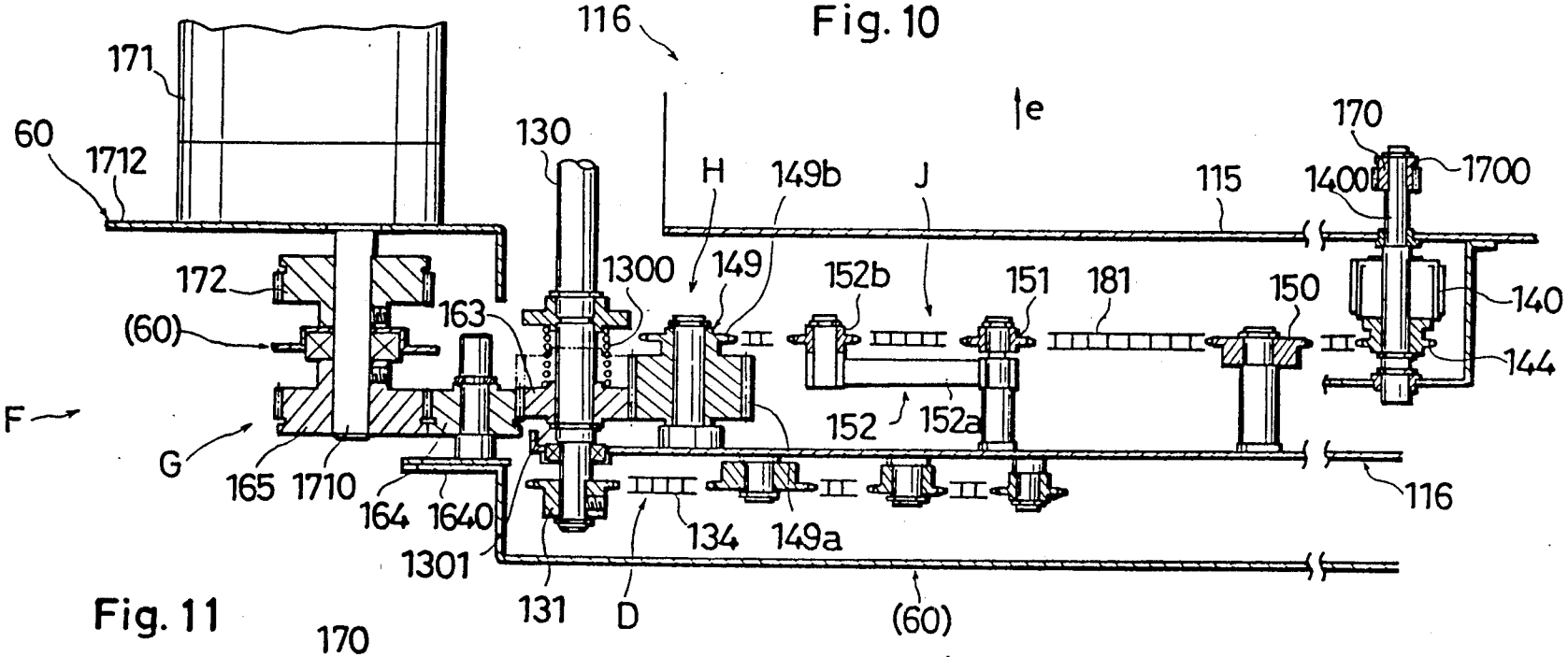
FIG. 10 is a cross sectional view of the same taken along the line X—X of FIG. 9.
Figure 11:
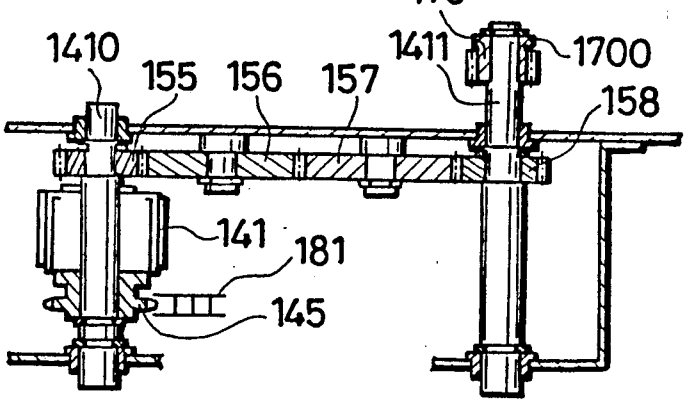
FIG. 11 is a cross sectional view of the same taken along the line XI—XI of FIG. 9.

As shown in FIGS. 9 and 10, the chain sprocket mechanism J comprises a sprocket portion **149*b* of the gear sprocket 149, sprockets 148, 150 and 151, each rotatably attached to the body 116, a chain tensioner 152 disposed between the sprockets 149 and 151, sprockets 144 through 147, and an endless chain 181 extended by the sprockets 144 through 147. The sprockets 144 through 147 are rotatably supported by clutch shafts 1400, 1410, 1420 and 1430, respectively, the above shafts belonging to the ON/OFF clutches 140 through 143 which are attached to the shelf unit 115**.

The sprockets 150, 144, 148 and 147 are arranged so that the chain 181 be run between sprockets 150 and 144 and between 148 and 147 in parallel with the moving direction of the shelf unit 115. By this arrangement, the sum of the lengths of the chain 181 between the sprockets 150 and 144 and between 148 and 147 is kept the same, irrespective of where the shelf unit 115 is. As a result, the tension of the chain 181 is always kept at substantially the same level.

The chain tensioner 152 (FIG. 9) comprises a lever **152*a* pivotally attached to a shaft of the sprocket 151, another sprocket 152*b* attached to a tip of the lever 152*a*, and a spring 152*c* for energizing the lever 152*a* downward. In this construction, the chain tensioner 152 prevents the chain 181** from getting loose after used for a long period, whereby to secure driving force conveyance.

The ON/OFF clutches 140 through 143 are, for example, electromagnetic clutches and are controlled by the control unit 6000 to engage or disengage the clutch shafts 1400, 1410, 1420 and 1430 and the sprockets 144 through 147, respectively.

As shown in FIG. 10, the clutch shaft 1400 is connected with a developing unit driving gear 170. The clutch shaft 1420 is connected with another developing unit driving gear 170 (not shown). As in FIG. 11, the clutch shaft 1410 is connected to a gear 155. A rotating shaft 1411 is connected to still another developing unit driving gear 170. The gear 155 is connected to the shaft 1411 through gears 156, 157 and 158, whereby the driving force of the gear 155 is conveyed to the shaft 1411 through the gears 156, 157 and 158. The clutch shaft 1430 is connected with a gear 159 (not shown). A rotating shaft 1431 is connected with still another developing unit driving the gear 170. The gear 159 is connected to the shaft 1431 through gears 160, 161 and 162, whereby the driving force of the gear 159 is conveyed to the shaft 1431 through the gears 160, 161 and 162.

The shafts 1400, 1411, 1420 and 1431 are uniformly distanced from the developing units 7 through 10, respectively. When each of the ON/OFF clutches 140 through 143 engages the shafts 1400, 1410, 1420 or 1430 and the sprockets 144, 145, 146 or 147, the corresponding shaft is rotated in a direction of an arrow g to convey the driving force of the developing motor 171 to the corresponding developing unit.

By the above arrangement of the clutches 140 through 143, a simple layout of the chain 181 can easily enlarge the angles of contact of the chain 181 around the sprockets 144 through 147. The clutches 140 through 143 may also arranged in a vertical line. In this case, the gears 155 through 162 can be eliminated. Another construction is possible in which only one sprocket is attached to the shelf unit 115, whereby the driving force from the chain 181 is conveyed to the clutches 140, 141, 142 and 143 through the sprocket and another conveying mechanism. In this case, the layout of the chain 181 can be more simplified.

Figure 14:
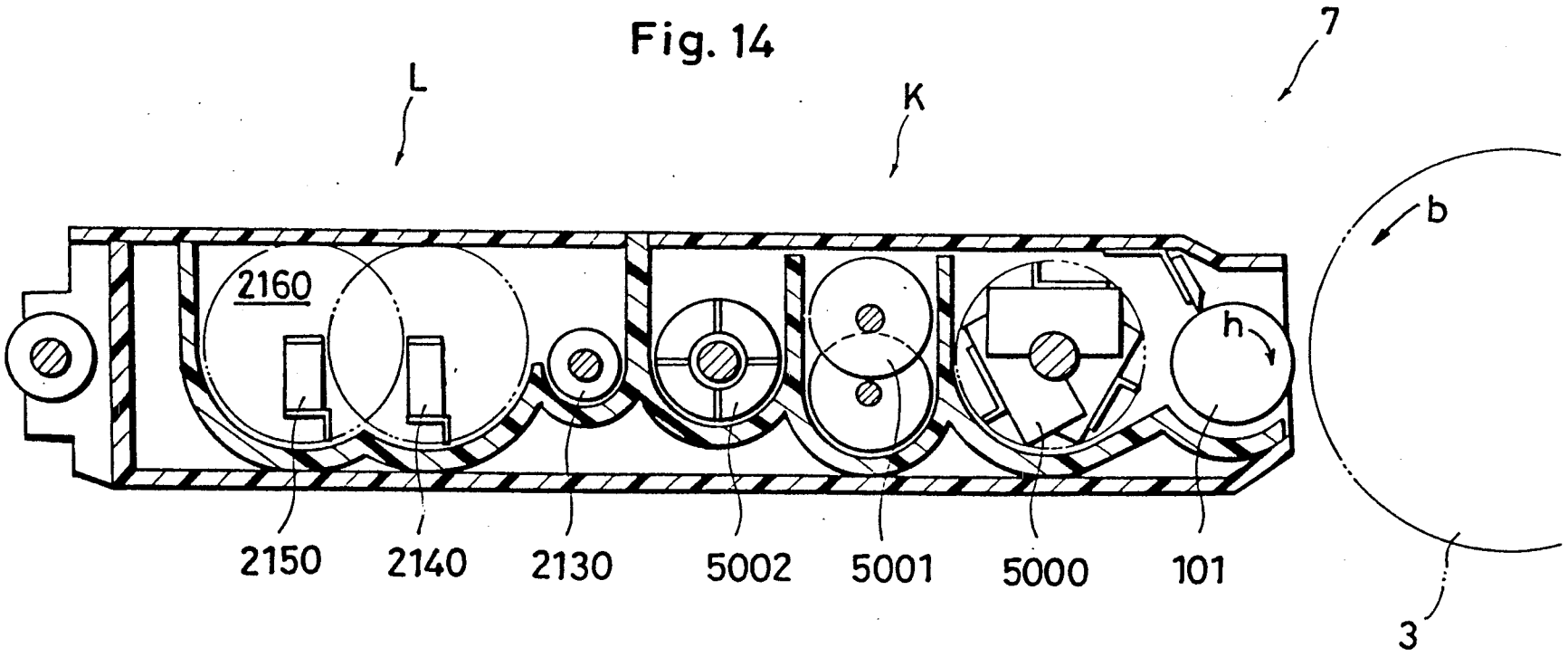
FIG. 14 is a cross sectional view of the same seen from the back of FIG. 1.

The developing unit 7 will be described in detail referring to FIGS. 12 through 14 as the example of the four developing units. The developing units 8 through 10 have the same construction as the unit 7, and their explanation will be omitted.

Figures 12, 13:
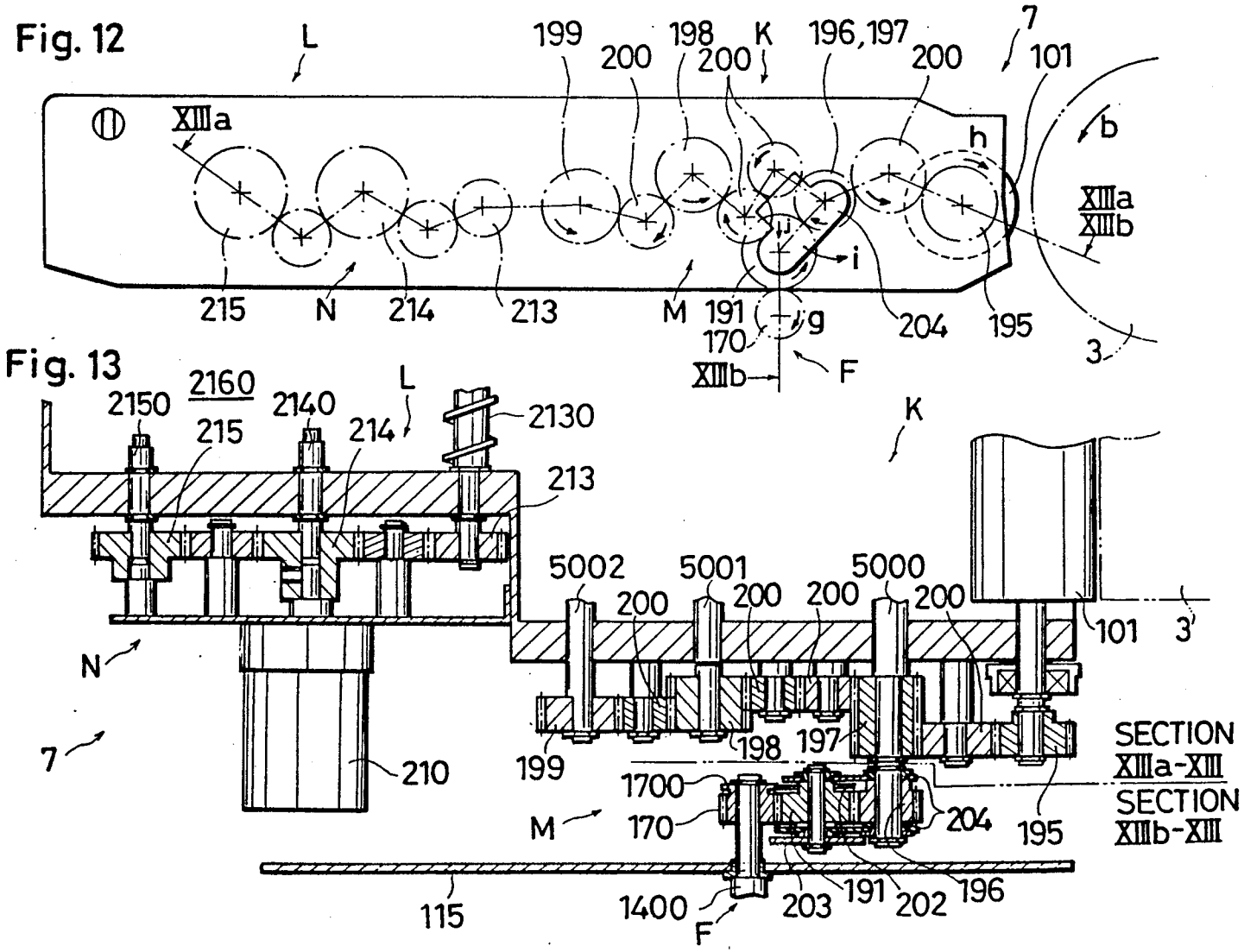
FIG. 12 is a view of a developing unit 7 seen from the back of FIG. 1.
FIG. 13 is a cross sectional view of the same taken along the lines XIIIa—XIIIa and XIIIb—XIIIb of FIG. 12.

As shown in FIGS. 12 and 13, the developing unit 7 comprises a developing section K disposed close to the photoconductive drum 3 and a toner supply section L disposed far from the drum 3. The developing section K accommodates a developer comprising the toner and carrier, and the toner supply section L accommodates the toner to be supplied to the developing section K.

The developing section K is equipped with a gearing mechanism M comprising a connecting gear 191 engaged with the developing unit driving gear 170, a developing sleeve gear 195 connected with a developing sleeve 101 as a developing roller, gears 196 through 199 and four idle gears 200. The gears 196 and 197 are connected to a bucket roller 5000, the gear 198 to a stirring roller 5001, and the gear 199 to another stirring roller 5002. In this construction, the driving force of the developing motor 171 is conveyed through the gear 170 to the connecting gear 191, whereby the developing sleeve 101 is rotated in a direction of an arrow h for development while receiving the developer from the roller 5000.

The developing unit 7 can be moved to a developing position close to the drum 3 or to a retracting position far from the drum 3. The following construction of the gearing mechanism M enables the driving force of the developing unit driving gear 170 to be conveyed to the developing unit 7 wherever it is.

The connecting gear 191 is rotatably attached to a lever 204, which is pivotally attached to an end of the bucket roller 5000. In this construction, when the gear 170 is rotated in a direction of an arrow g, the lever 204 is pivoted in a direction of an arrow i, whereby to rotate the gear 191 in a direction of an arrow j. Accordingly, the driving force of the gear 170 is conveyed to the gear 191 with the two gears pressed on each other, whereby the conveyance is conducted without fail. In order to prevent too deep intermeshing of these gears, the gear 170 has an adjusting disc portion 1700 and the gear 191 is connected with an adjusting disc 202. The gear 191 is disposed right above the gear 170 when the developing unit 7 is at the developing position in this embodiment. The lever 204 has a protective disc 203 provided concentrically with the gear 191 and having a larger outer diameter than the gear 191. The disc 203 is provided for preventing the gear 191 from directly contacting and damaging shelves or the like (not shown) of the shelf unit 115 when, for example, the developing unit 7 is loaded in the shelf unit 115.

The toner supply section L comprises a toner supply motor 210, a gearing mechanism N, a screw 2130, stirring plates 2140 and 2150 and a hopper 2160 for storing the toner. The gearing mechanism N comprises a screw gear 213 and gears 214 and 215. The stirring plates 2140 and 2150 are provided for preventing the toner in the hopper 2160 from condensing. In this construction, the driving force of the toner supply motor 210 is conveyed through the mechanism N to rotate the screw 2130 and the stirring plates 2140 and 2150.

Hereinafter, how the toner is mixed into the developer and supplied will be described. The bucket roller 5000 and the stirring rollers 5001 and 5002 are to transport the toner and the developer between the back and the front of the developing unit 7 (vertically to the paper surface of FIG. 14). Furthermore, the transporting direction of the rollers 5000 and 5002 are opposite to that of the roller 5001. The transport of the developer and the toner is, for example, is done in the following way. The developer is supplied by the roller 5001 to the entrance (back of FIG. 1) of the roller 5002. On the other hand, the toner is supplied from the hopper 2160 by the screw 2130 and is mixed into the developer at the above entrance of the roller 5002. Then, the developer added with the toner is transported from back to front by the roller 5002 while being stirred, turned around and transported from front to back by the roller 5001 while stirred, and turned around again and transported from back to front by the roller 5000. In this way, the developer is supplied to the developing sleeve 101. It is for uniformizing the toner density and thus to prevent developing unevenness that the developer is stirred for such a long period of time before reaching the sleeve 101. After supplied to the sleeve 101, the developer is retained on its surface by the magnetic force of a magnetic roller having multiple polarities and fixed in the sleeve 101, and then is sent to oppose the drum 3 in accompaniment with the rotation of the sleeve 101 for development.

Whereas the developing section K is continuously driven throughout development, the toner supply section L is driven only when the toner density in the section K is lowered than the specified level.

The toner supply section L may be driven by a driving force supplied from outside of the shelf unit 115. Even driving the section L by the toner supply motor 210 as mentioned above has little adverse effects on the movement of the shelf unit 115 since the motor 210 can be relatively light and small.

The developer is not limited to a two-component type as above, but may be a one-component type comprising only the toner.

The developing unit pressing mechanism P will be described in detail referring to FIGS. 9 and 15. The mechanism P is for moving the developing unit 7 in a direction of an arrow k to the developing position and in a direction of an arrow m back to the retracting position.

Figure 15:
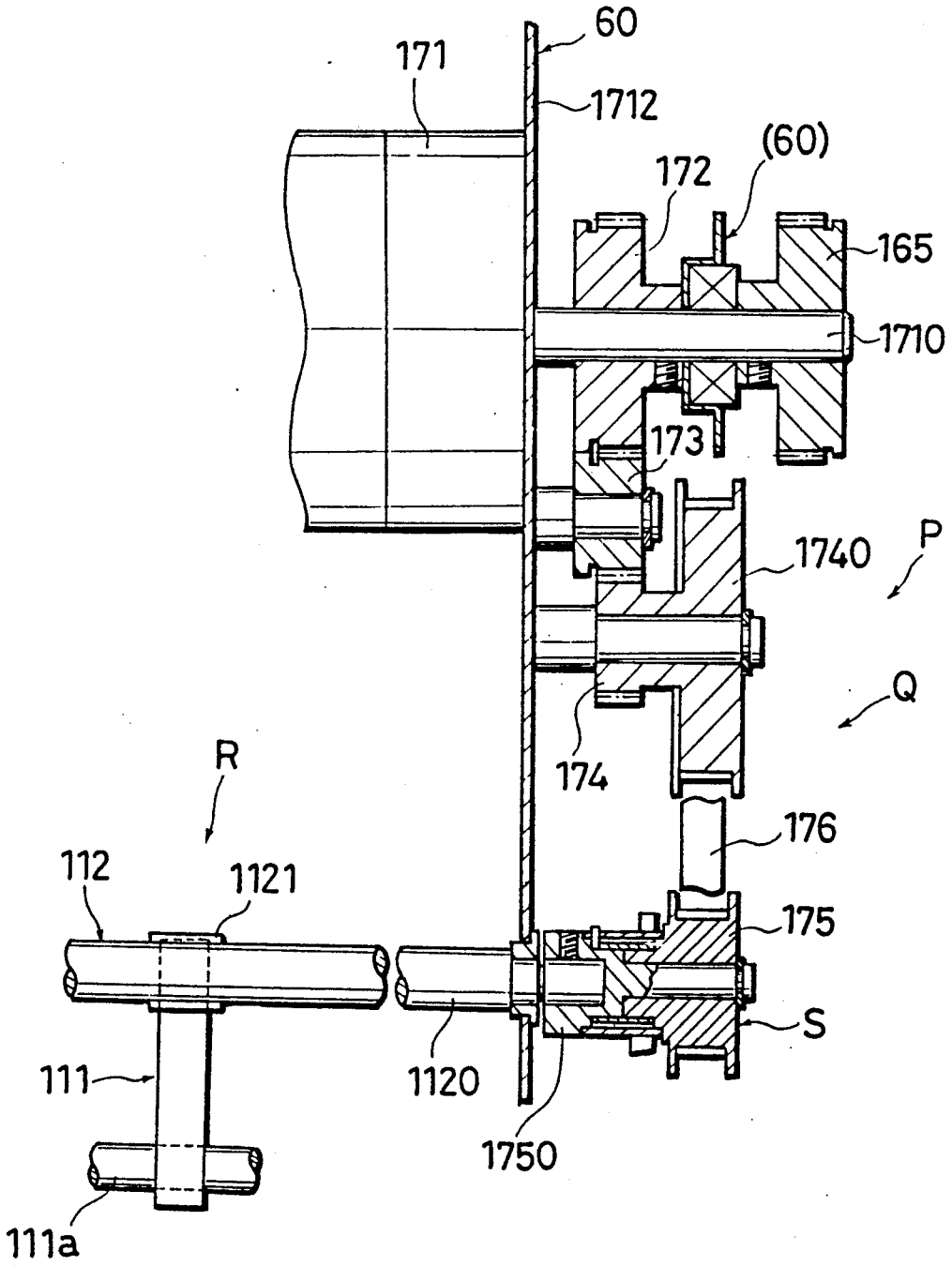
FIG. 15 is a cross sectional view taken along the line XV-XV of FIG. 9.

As in FIG. 15, the mechanism P comprises a driving section Q for driving the developing motor 171 and a cam section R for pressing the developing unit 7.

The driving section Q (FIG. 9) comprises a driving gear 172 connected to the developing motor 171, an intermediate gear 173 rotatably attached to the casing 60, a subordinate gear 174 having a driving pulley 1740, a timing belt 176, and a spring clutch mechanism S having a subordinate pulley 175 and a connecting shaft 1750. The spring clutch mechanism S further has a lever 179, which is to be driven by the solenoid 178 to rotate the connecting shaft 1750 by 180° each time.

The cam section R (FIG. 15) comprises a rotating cam 112 having a cam shaft 1120 connected to the connecting shaft 1750 and a pressing portion 1121 fixed to the shaft 1120, and a pivoting cam 111 to be pivoted in directions of arrows n and p with a shaft 111*a* as the pivoting axis.

In this construction, the pivoting cam 111 is pivoted in the n direction before the developing unit 7 is elevated to oppose the drum 3. In accordance with the elevation of the developing unit 7, a cushion member 110 (FIG. 9) provided at an end of the developing unit 7 is guided to a cam surface 1110 of the pivoting cam 111, whereby the developing unit 7 is moved in the k direction smoothly.

The copier 1 is equipped with an alleviating member 135 for preventing the developing sleeve 101 from directly contacting and damaging the drum 3 when the developing unit 7 is moved to the developing position.

In the above embodiment, the developing sleeve 101 is employed as the developing roller. However, a rotating magnetic roller may also be employed.

The above embodiment employ both the elevating motor 120 for driving the shelf unit 115 and the developing motor 171 for driving the developing unit 7. There is another possible construction, wherein a solenoid is provided between the sprockets 148 and 149 for locking the chain 181 to the shelf 115 and another solenoid is provided between the sprockets 144 and 150 for locking the chain 181 of this portion in the shelf 115. In this case, the sprockets 148 and 149 should be arranged to run the chain 181 therebetween in parallel with the moving direction of the developing unit 7, and in the same manner the sprockets 144 and 150 should be arranged to run the chain 181 therebetween in parallel with the moving direction of the developing unit 7. In this construction, the shelf unit 115 is moved up and down by the developing motor 171 when the chain 181 is locked to the shelf unit 115 by the solenoids. If the developing motor 171 can also be rotated in reverse, only one solenoid is enough.

Instead of the chain sprocket mechanisms employed in the above embodiment, belt pulley mechanisms, wires, ropes or the like may be used.

Although multiple developing units are integrally moved by accommodating them in a shelf unit in the above embodiment, they may be moved up and down individually.

Application of this invention to a color copier has been explained. Needless to say, this invention may be applied to any apparatus equipped with a plurality of developing units.

Although the present invention has been fully described by way of an embodiment with references to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device comprising:

a plurality of developing units, each of which has a developing roller for developing an electrostatic latent image formed on an image carrier;

a fixed driving source for generating a driving force to drive the developing rollers of each of said developing units;

supporting means for supporting said plurality of developing units for vertical movement relative to the image carrier and the fixed driving source; and connecting means for connecting said fixed driving source to the developing rollers of each of said developing units, said connecting means comprising movable rotating means including at least one movable rotating member vertically-movable together with said developing units;

a wrapping member for conveying the driving force from the fixed driving source to the movable rotating means; and a plurality of clutch means, each of which is provided for one of said plurality of developing units and each of which is switchable between a first state wherein the clutch means conveys the driving force from the movable rotating means to the developing roller of its respective developing unit and a second second state wherein there is no conveyance from the movable rotating means to the developing roller of its respective developing unit.

2. A developing device of claim 1, wherein the wrapping member is extended by an upper rotating member, a lower rotating member and the movable rotating means, the upper rotating member and the lower rotating member being respectively fixed above and below said developing units.

3. A developing device of claim 2, wherein a potion of the wrapping member extended between the upper rotating member and the movable rotating means and another portion of the wrapping member extended between the movable rotating means and the lower rotating member are in parallel with a moving direction of said developing units.

4. A developing device of claim 1, wherein the movable rotating means comprises a plurality of movable rotating members and the wrapping member is in contact with a first movable rotating member and a second movable rotating member on opposed sides of the wrapping member.

5. A developing device of claim 1, further comprising moving means for moving said developing units between a developing position close to the image carrier and a retracting position far from the image carrier, and a pivoting lever and a gear rotatably attached to the pivoting lever for each of said developing units, and wherein the pivoting lever of each developing unit is pivotable to cause the gear to convey the driving force from the movable rotating means to its respective developing unit.

6. A developing device comprising:

a plurality of developing units, each of which has a developing roller for developing an electrostatic latent image formed on an image carrier;

a fixed driving source for generating a driving force to drive the developing rollers of each of said developing units;

developing unit switching means for moving said developing units linearly relative to said image carrier and said fixed driving source and for selecting one of said developing units to oppose the image carrier; and connecting means for connecting said fixed driving source to the developing rollers of each of said developing units, said connecting means comprising movable rotating means including at least one movable rotating member movable together with said developing units;

a wrapping member for conveying the driving force from the fixed driving source to the movable rotating means; and a plurality of clutch means, each of which is provided for one of said plurality of developing units and each of which is switchable between a first state wherein the clutch means conveys the driving force from the movable rotating means to the developing roller of its respective developing unit and a second state wherein there is no conveyance from the movable rotating means to the developing roller of its respective developing unit.

7. A developing device of claim 6, wherein the wrapping member is extended by a first rotating member, a second rotating member and the movable rotating means; the first and second rotating members being respectively fixed beyond ends of a moving area of said developing units.

8. A developing device of claim 7, wherein a portion of the wrapping member extended between the first rotating member and the movable rotating means and another portion of the wrapping member extended between the movable rotating means and the second rotating member are in parallel with a moving direction of said developing units.

9. A developing device of claim 6, wherein the movable rotating means comprises a plurality of movable rotating members and the wrapping member is in contact with a first movable rotating member and a second movable rotating member on opposed sides of the wrapping member.

10. A developing device of claim 6, further comprising moving means for moving said developing units between a developing position close to the image carrier and a retracting position far from the image carrier, and a pivoting lever and a gear rotatably attached to the pivoting lever for each of said developing units, and wherein the pivoting lever of each developing unit is pivotable to cause the gear to convey the driving force from the moving rotating means to its respective developing unit.

11. A developing device comprising:

a plurality of developing units, each of which has a developing roller for developing an electrostatic latent image formed on an image carrier;

a fixed driving source for generating a driving force to drive the developing rollers of each of said developing units;

developing unit switching means for moving said developing units linearly relative to said image carrier and said fixed driving source and for selecting one of said developing units to oppose the image carrier;

connecting means for connecting said fixed driving source to the developing rollers of each of said developing units, said connecting means comprising movable rotating means including at least one movable rotating member movable together with said developing units;

a wrapping member for conveying the driving force from the fixed driving source to the movable rotating means; and a plurality of clutch means, each of which is provided for one of said plurality of developing units and each of which is switchable between a first state wherein the clutch means conveys the driving force from the movable rotating means to the developing roller of its respective developing unit and a second state wherein there is no conveyance from the movable rotating means to the developing roller of its respective developing unit; and control means for switching said clutch means between the first state and the second state.

12. A developing device of claim 11, wherein the wrapping member is extended by a first rotating member, a second rotating member and the movable rotating means; the first and second rotating members being respectively fixed beyond ends of a moving area of said developing units.

13. A developing device of claim 12, wherein a portion of the wrapping member extended between the first rotating member and the movable rotating means and another portion of the wrapping member extended between the movable rotating means and the second rotating member are in parallel with a moving direction of said developing units.

14. A developing device of claim 11, wherein the movable rotating means comprises a plurality of movable rotating members and the wrapping member is in contact with a first movable rotating member and a second movable rotating member on opposed sides of the wrapping member.

15. A developing device of claim 11, further comprising moving means for moving said developing units between a developing position close to the image carrier and a retracting position far from the image carrier, and a pivoting lever and a gear rotatably attached to the pivoting lever for each of said developing units, and wherein the pivoting lever of each developing unit is pivotable to cause the gear to convey the driving force from the moving rotating means to its respective developing unit.

16. In a developing device wherein a shelf unit movable up and down against an image carrier accommodates a plurality of developing units in shelves thereof, said developing unit being selectively driven to cooperate with the image carrier for development, the improvement comprising a motor fixed outside the movable shelf unit such that said shelf unit and said plurality of developing units accommodated thereby are movable relative to said fixed motor for generating a driving force to be conveyed by a conveying mechanism, and an ON/OFF clutch provided in each of said plurality of developing units, for selectively connecting said conveying mechanism to its respective developing unit for selectively driving the developing units.

* * * * *